US006769681B2

(12) United States Patent
Nakamura et al.

(10) Patent No.: US 6,769,681 B2
(45) Date of Patent: Aug. 3, 2004

(54) PAPER FEED CASSETTE PROVIDED WITH A SIZE DETECTION FUNCTION

(75) Inventors: Nobuyuki Nakamura, Nara (JP); Masahiro Someda, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/241,526

(22) Filed: Sep. 12, 2002

(65) Prior Publication Data

US 2003/0047864 A1 Mar. 13, 2003

(30) Foreign Application Priority Data

Sep. 12, 2001 (JP) ..... 2001-276812

(51) Int. Cl.[7] ..... B65H 1/00
(52) U.S. Cl. ..... 271/171; 271/145; 271/162
(58) Field of Search ..... 271/171, 162, 271/145

(56) References Cited

U.S. PATENT DOCUMENTS 4,190,246 A * 2/1980 Sasuga ..... 271/145
5,328,166 A * 7/1994 Hokamura ..... 271/171
6,014,229 A * 1/2000 Yun ..... 358/449
6,116,590 A * 9/2000 Yokoyama et al. ..... 271/171

FOREIGN PATENT DOCUMENTS

JP 05-058465 3/1993

* cited by examiner

*Primary Examiner*—Donald D. P. Walsh
*Assistant Examiner*—Kaitlin S Joerger
(74) *Attorney, Agent, or Firm*—Birch, Stewart, Kolasch & Birch, LLP

(57) ABSTRACT

A paper feed cassette having a size detection function has a paper stage formed integrally with a rear end restricting plate for restricting the rear end of paper sheets. On the bottom of the paper stage, a plurality of rib-like detection targets are arranged in the paper feed direction. The detection targets are detected by a plurality of detection switches arranged in the paper feed direction in a paper feed portion inside the main body of an image forming apparatus. A discriminator receives the detection signals from the detection switches and thereby recognizes the paper size and the presence/absence of the paper feed cassette.

4 Claims, 3 Drawing Sheets

PAPER FEED CASSETTE PROVIDED WITH A SIZE DETECTION FUNCTION

BACKGROUND OF THE INVENTION

1. Field of the Invention

The present invention relates to a paper feed cassette that is removably mounted inside an image forming apparatus such as a printer, facsimile machine, or copier of any type. More particularly, the present invention relates to a paper feed cassette provided with a size detection function which permits the detection of paper size and of the presence/absence of the paper feed cassette itself.

2. Description of the Prior Art

An image forming apparatus, irrespective of the type, typically has a paper feed portion provided inside the body thereof, where a paper feed cassette for holding sheets of paper (recording paper) is removably mounted. While paper is being fed from the paper feed cassette to the image forming portion of the image forming apparatus, a formed image is transferred to the paper.

The paper feed cassette is often so structured as to hold paper of different sizes, and therefore, at the stage of image formation, the size of the paper currently loaded therein needs to be recognized precisely so that an image is formed according to the size of the paper fed therefrom.

For this purpose, in many cases, a detecting means is provided that detects the size of the paper loaded in the paper feed cassette when it is mounted in the paper feed portion of the image forming apparatus, and the detection signal from the detecting means is fed to the image forming portion of the image forming apparatus.

For example, Japanese Patent Application Laid-Open No. H5-58465 proposes a recording paper recognition structure as shown in FIGS. 3A to 3C which permits the recognition of three different paper sizes, namely, letter size (with a total length of L1), A4 size (with a total length of L2), and legal size (with a total length of L3), by detecting, with two detection switches S1 and S2 provided in the paper feed portion, the bottom of a guide plate 201 provided integrally with a rear end restricting plate 200 on the paper feed cassette.

Specifically, when the paper feed cassette is mounted inside the image forming apparatus, if the detection switches S1 and S2 are both on, the paper loaded therein is recognized as letter size; if the detection switch S1 is on and the detection switch S2 is off, the paper is recognized as A4 size; if the detection switches S1 and S2 are both off, the paper is recognized as legal size.

In case the user carelessly requests printing without the paper feed cassette mounted in the paper feed portion or in similar situations, it is preferable to inhibit image reading and image formation and warn the user of the absence of the paper feed portion.

To achieve this, the presence/absence of the paper feed cassette (i.e., whether it is mounted or not) needs to be detected. However, in the conventional example (Japanese Patent Application Laid-Open No. H5-58465) described above, the state shown in FIG. 3C, in which legal-size paper is recognized, is identical with the state in which the paper feed cassette is absent. That is, to make it possible to detect also the presence/absence of the paper feed cassette, at least three switches are needed. This increases the number of components and complicates the structure.

SUMMARY OF THE INVENTION

An object of the present invention is to provide a paper feed cassette provided with a size detection function which has a simple structure but nevertheless permits the recognition of three or more different image sizes and of the presence/absence of the paper feed cassette.

To achieve the above object, according to the present invention, a paper feed cassette provided with a size detection function for use in an image forming apparatus, which paper feed cassette has a rear end restricting plate for restricting the position of the rear end of paper and is removably mounted in a paper feed portion provided inside the main body of the image forming apparatus, is provided with: a plurality of detection targets arranged along the paper feed direction on the bottom of a paper stage formed integrally with the rear end restricting plate; a plurality of detection switches, arranged along the paper feed direction in the paper feed portion inside the main body of the image forming apparatus, for detecting the positions of the detection targets; and a discriminator for recognizing paper size and the presence/absence of the paper feed cassette by receiving detection signals from the detection switches. In this structure, assuming that there are provided N detection switches, it is possible to recognize at least (N+1) different paper sizes and the presence/absence of the paper feed cassette.

In this structure, the detection targets formed on the bottom of the paper stage can be formed integrally with the paper stage when it is produced. For example, in a case where the paper stage is formed out of resin, it is so molded as to have projections on the bottom thereof This eliminates the need to prepare separate members, and thus makes it possible to realize a simple and inexpensive paper feed cassette provided with a size detection function which permits the recognition of many different states of the paper feed cassette.

According to the present invention, there are provided, for example, two detection switches and four detection targets, and the discriminator permits the recognition of 3 different paper sizes and of the presence/absence of the paper feed cassette.

In this structure, on the bottom of the paper stage, four detection targets are formed at predetermined intervals along the paper feed direction, and these detection targets are detected by two detection switches arranged along the paper feed direction in the paper feed portion inside the main body of the image forming apparatus. In this way, it is possible to recognize three different paper sizes (for example, letter size, A4 size, and legal size) and whether the paper feed cassette is present or absent.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Hereinafter, a paper feed cassette provided with a size detection function according to the present invention will be described in detail with reference to the drawings.

Figure 1:
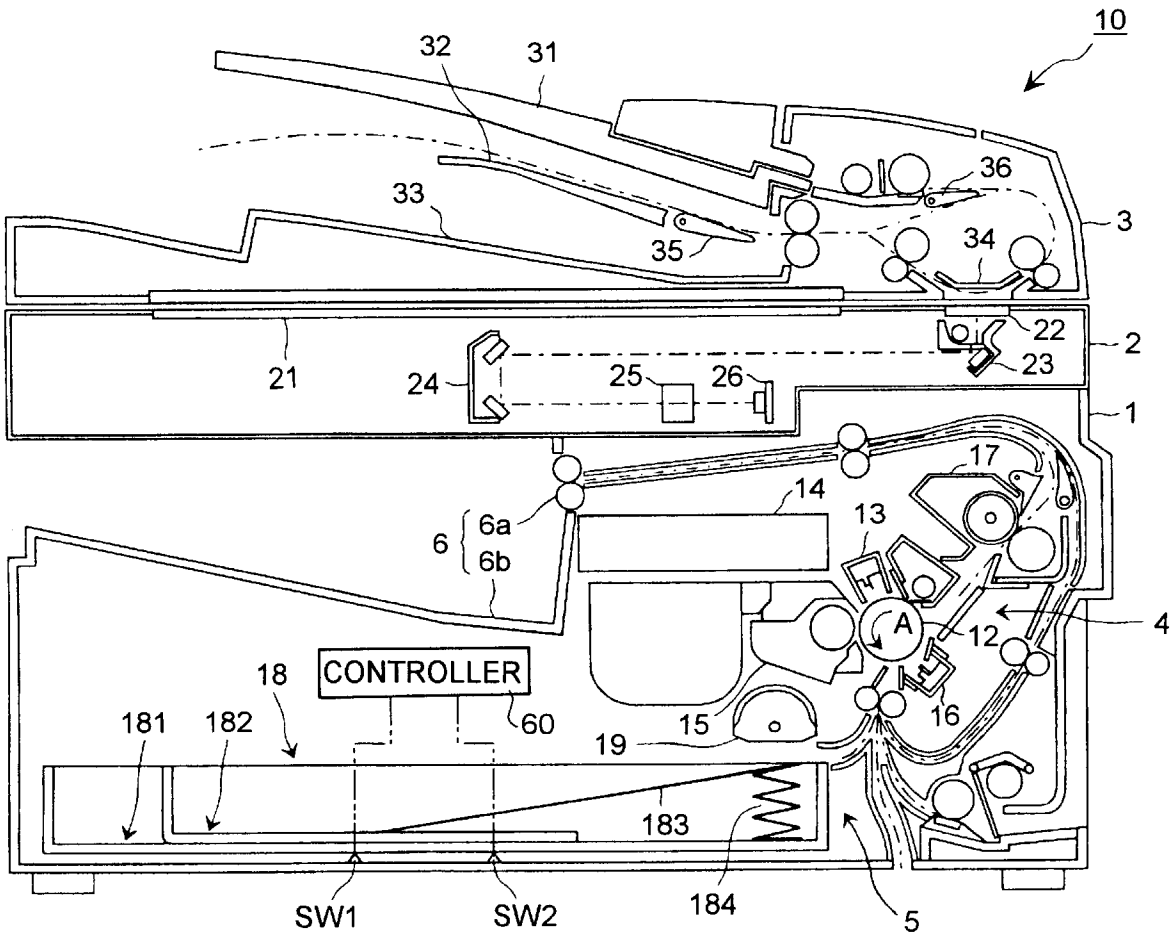
FIG. 1 is a diagram showing the construction of an image forming apparatus to which applies a paper feed cassette provided with a size detection function according to the invention.

FIG. 1 shows the overall construction of a copier. This copier 10 has a scanner portion 2 arranged above a main body 1, and has an automatic document feeder 3 mounted on the top surface of the scanner portion 2. Inside the main body 1, in the center thereof, is arranged an image forming portion 4, which is composed of a charger 13, an exposure unit 14, a developer unit 15, and a transfer unit 16 arranged around a photoconductive drum 12 supported so as to be rotatable in the direction indicated by arrow A. Arranged below are a paper feed portion 5 provided with a paper feed cassette 18 for holding a plurality of sheets of paper and a paper feed roller 19.

Moreover, in the main body 1, in the space secured between the scanner portion 2 and the paper feed portion 5, is formed a paper discharge portion 6 provided with discharge rollers 6*a* and a discharge tray 6*b*. Furthermore, inside the main body 1, a paper transport path is formed by transport rollers and transport guides so as to run from the paper feed portion 5 through the image forming portion 4 to the paper discharge portion 6. In this paper transport path, between the image forming portion 4 and the paper discharge portion 6, is arranged a fuser unit 17.

The scanner portion 2 has a document stage 21 and a contact glass 22, both formed out of hard transparent glass, arranged in the top surface thereof Arranged below are a first mirror base 23 having a light source lamp and a mirror mounted thereon, a second mirror base 24 having mirrors mounted thereon, a lens 25 with a zooming function, and a photoelectric conversion device 26 such as a CCD.

When a document is placed manually on the top surface of the document stage 21 with the automatic document feeder 3 opened and then closed, the first and second mirror bases 23 and 24 reciprocate parallel to the document stage 21 at constant speeds of v and v/2, respectively. Meanwhile, the image surface of the document placed on the document stage 21 is exposed and scanned with the light from the light source lamp, and the light reflected from the image surface of the document is directed by way of the mirrors to the lens 25.

The lens 25 images the light reflected from the image surface of the document on the light-receiving surface of the photoelectric conversion device 26. The photoelectric conversion device 26 outputs an electrical signal that varies according to the amount of light received on the light-receiving surface. The signal output from the photoelectric conversion device 26 is converted into digital data and then subjected to predetermined image processing by an unillustrated image processor, and is then fed to the exposure unit 14 of the image forming portion 4.

The automatic document feeder 3 openably covers the top surface of the scanner portion 2 including the document stage 21 and the contact glass 22. The automatic document feeder 3 is provided with a document tray 31 in which a plurality of document sheets are set, an intermediary tray 32 for temporarily storing double-faced document sheets of which one face has already been read, a discharge tray 33 into which are discharged document sheets of which the images have already been read, and a platen 34 arranged so as to face the contact glass 22.

Inside the automatic document feeder 3, a document transport path is formed so as to run from the document tray 31 then between the contact glass 22 and the platen 34 to the intermediary tray 32 and also to the discharge tray 33. In this document transport path are provided flappers 35 and 36.

The flapper 35 opens the document transport path leading to the intermediary tray 32 when, in a double-face reading mode, the first face is read, and opens the document transport path leading to the discharge tray 33 in a single-face reading mode or when, in the double-face reading mode, the second face is read. The flapper 36 opens the document transport path leading from the document tray 31 to between the contact glass 22 and the platen 34 in the single-face reading mode or when, in the double-face reading mode, the first face is read, and opens the document transport path leading from the intermediary tray 32 to between the contact glass 22 and the platen 34 when, in the double-face reading mode, the second face is read.

When a document is copied with the document set in the document tray 31 so that it is automatically fed by the automatic document feeder 3, the first mirror base 23 of the scanner portion 2 remains right under the contact glass 22, and, while the document is being passed between the contact glass 22 and the platen 34, the image surface thereof is exposed and scanned relatively with the light from the light source lamp.

When an image is formed, in the image forming portion 4, the photoconductive drum 12 is rotated at a predetermined speed in the direction indicated by arrow A so that its surface faces the charger 13, exposure unit 14, developer unit 15, and transfer unit 16 in this order. Thus, the surface of the photoconductive drum 12 is charged uniformly with single-polarity electric charge by the charger 13, and is then irradiated by the exposure unit 14 with image light, such as a laser beam, modulated according to the image data, with the result that an electrostatic latent image is formed on the surface of the photoconductive drum 12. This electrostatic latent image is made visible by being converted into a toner image by the developer unit 15, and is then transferred by the transfer unit 16 to the paper fed from the paper feed cassette 18 of the paper feed portion 5.

The paper having the toner image transferred thereto is then heated and pressed by the fuser unit 17, so that the toner image is fixed on the surface of the paper. In the double-face copying mode, a paper sheet having an image copied on the first face thereof is again, though with the top face down this time, transported to between the photoconductive drum 12 and the charger 13. A paper sheet having an image copied thereon in the single-face copying mode or a paper sheet having an image copied on the second face thereof in the double-face copying mode is discharged through the discharge roller 6*a* into the discharge tray 6*b*.

Figure 2A:
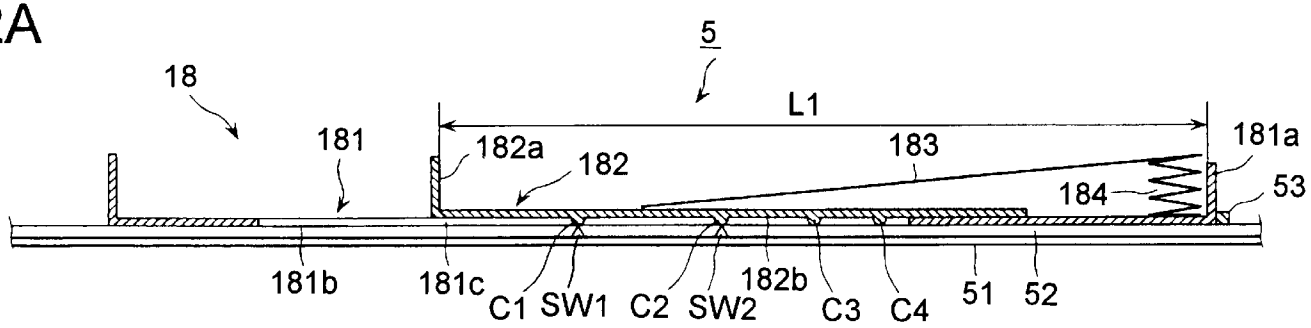
FIGS. 2A, 2B, and 2C are diagrams illustrating the structure of the paper feed cassette provided with a size detection function.
Figure 2B:
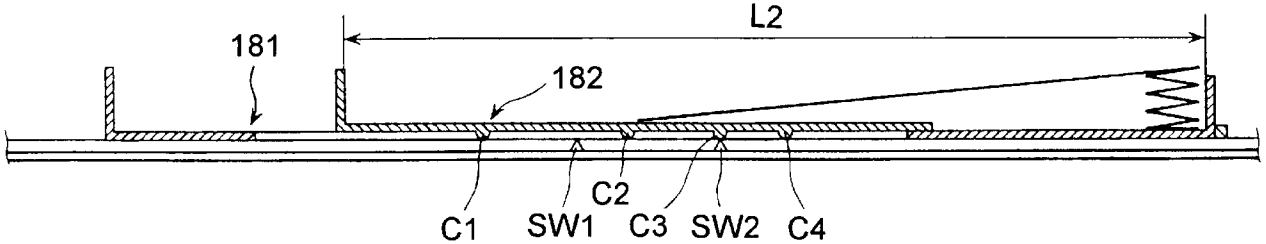
Figure 2C:
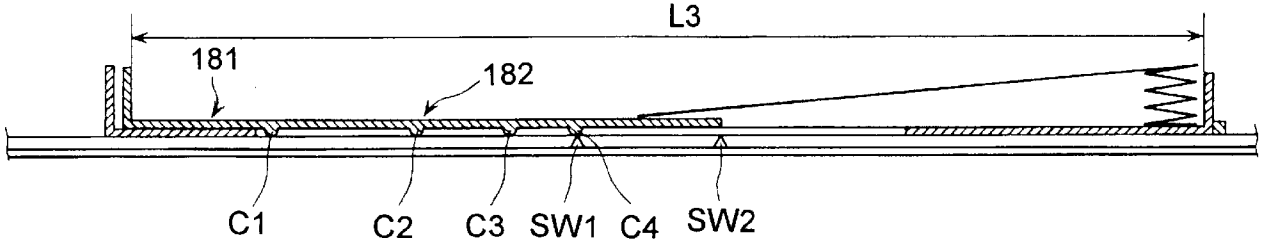
Figure 3A:
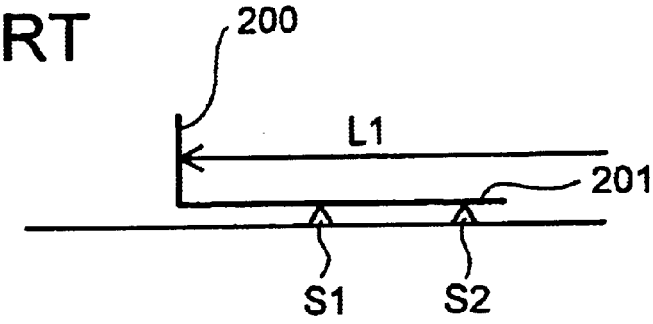
FIG.3A PRIOR ART
FIGS. 3A, 3B, and 3C are diagrams illustrating an example of a conventional paper feed cassette provided with a size detection function.
Figure 3B:
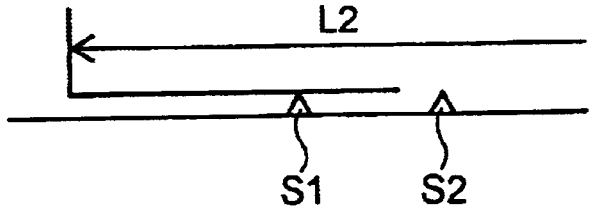
FIG.3B PRIOR ART
Figure 3C:
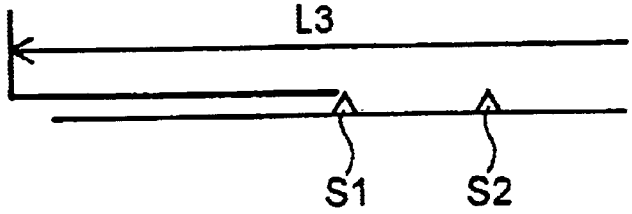
FIG.3C PRIOR ART

In the copier 10 constructed as described above, the paper feed cassette 18 (a paper feed cassette provided with a size detection function), which holds sheets of paper (recording paper) in the form of a stack, is, as shown in FIGS. 2A to 2C, composed of a cassette casing 181 and a paper stage 182 placed inside the cassette casing 181 so as to be freely movable along the paper feed direction. The paper feed cassette 18 is removably mounted in the paper feed portion 5 of the main body 1 from the outside.

The paper feed cassette 18 is so structured as to permit the recognition of three different paper sizes, for example, letter size, A4 size, and legal size, and also the detection of the presence/absence of the paper feed cassette 18 itself Now, the structure of the paper feed cassette 18 and the paper feed portion 5 will be described.

A pair of guide rails 52 are arranged parallel to the paper feed direction on, and along opposite sides of, a bottom plate 51 of the paper feed portion 5 of the main body 1. The cassette casing 181, at opposite sides of the bottom surface thereof, rides and slides on these guide rails 52. When a front plate 181*a* of the cassette casing 181 makes contact with a stopper 53 provided on the bottom plate 51, the cassette casing 181 stops and is latched in a predetermined position corresponding to the paper feed roller 19 (see FIG. 1). When the cassette casing 181 is replenished with paper, it is pulled out of the main body 1 with an unillustrated grip held with a hand so that the cassette casing 181 is unlatched.

On a bottom plate 181*b* of the cassette casing 181, the paper stage 182 is placed so as to be movable along the paper feed direction according to the size of the paper placed thereon. On the bottom surface 182*b* of the paper stage 182, four detection targets C1, C2, C3, and C4 are formed at predetermined intervals along the paper feed direction so as to protrude downward (the detection targets C1, C2, C3, and C4 are formed as, for example, ribs, though not limited thereto). These detection targets C1, C2, C3, and C4 loosely fit into an elongate hole 181*c* formed along the paper feed direction in the bottom plate 181*b* of the cassette casing 181 so that the tips of the detection targets C1, C2, C3, and C4 face the bottom plate 51 of the paper feed portion 5 of the main body 1.

On the paper stage 182, the rear end of a paper lifting plate 183 is placed, of which the front end is fixed to the top end of a spring 184 fixed to the bottom plate 181*b* of the cassette casing 181. This permits the topmost sheet of paper to be pressed onto the paper feed roller 19.

With the paper lifting plate 183 kept in a predetermined position, the paper stage 182 can be moved forward and backward according to the size of the paper placed thereon. Though not illustrated, inside the cassette casing 181, somewhat inward from opposite sides thereof, side restricting plates that make contact with the paper from opposite sides in the width direction thereof and thereby keep it in position are provided so as to be slidable in the direction perpendicular to the paper feed direction.

On the other hand, on the bottom plate 51 of the paper feed portion 5 of the main body 1, in a predetermined position corresponding to the detection targets C1, C2, C3, and C4 formed on the bottom surface 182*b* of the paper stage 182, two switches SW1 and SW2 are arranged at a predetermined interval. The detection signals from these switches SW1 and SW2 are fed to the controller (a discriminator) 60 provided in the main body 1.

The controller 60 is provided with a CPU for performing various calculations and a ROM and a RAM for storage. On receiving the detection signals from the switches SW1 and SW2, the controller 60 detects the size of the paper placed in the form of a stack on the paper stage 182 and whether the paper feed cassette 18 is mounted in the paper feed portion 5 or not. The controller 60 then indicates the detection results on an operation panel (not shown), and outputs a control signal to the image forming portion 4 to control the image to be formed on the paper.

Next, the relative positions and other features of the detection targets C1, C2, C3, and C4 and the detection switches SW1 and SW2 will be described with reference to FIGS. 2A to 2C. First, the paper feed cassette 18 is pulled out of the paper feed portion 5. Then, sheets of paper are placed in it so as to be held in position, with the front end of the paper sheets kept in contact with the front plate 181*a* of the cassette casing 181, and with the paper stage 182 so moved that the rear end of the paper sheets is kept in contact with a rear plate (paper rear end restricting plate) 182*a* of the paper stage 182. Then, a front portion of the paper is pressed down against the force of the spring 184 so that the paper lifting plate 183 is latched. Now, the cassette casing 181 is pushed into the paper feed portion 5 until, when the front plate 181*a* thereof makes contact with the stopper 53, the paper lifting plate 183 is unlatched in that position and is pushed upward. As a result, the topmost sheet of paper is pressed onto the paper feed roller 19, becoming ready to be fed.

When the paper feed cassette 18 is mounted in the paper feed portion 5 in this way, if the paper loaded therein is of letter size with a total length of L1, as shown in FIG. 2A, the distance between the front plate 181*a* of the cassette casing 181 and the rear plate 182*a* of the paper stage 182, with the paper neatly loaded, equals L1. In this case, two of the detection targets, namely C1 and C2, make contact with the detection switches SW1 and SW2, respectively, and are thus detected.

If the paper is of A4 size with a total length of L2, as shown in FIG. 2B, the distance between the front plate 181*a* of the cassette casing 181 and the rear plate 182*a* of the paper stage 182, with the paper neatly loaded, equals L2. In this case, only the detection target C3 makes contact with the detection switch SW2 and is thus detected.

If the paper is of legal size with a total length of L3, as shown in FIG. 2C, the distance between the front plate 181*a* of the cassette casing 181 and the rear plate 182*a* of the paper stage 182, with the paper neatly loaded, equals L3. In this case, only the detection target C4 makes contact with the detection switch SW1 and is thus detected.

Though not illustrated, if the paper feed cassette 18 itself is not mounted in the paper feed portion 5, neither of the detection switches SW1 and SW2 detects any of the detection targets C1, C2, C3, and C4. Table 1 shows a summary of all the possible detection results, where a "1" and "0" represent the on and off states, respectively, of a detection switch.

TABLE 1

| Paper Size | SW1 | SW2 |
|---|---|---|
| Letter Size | 1 | 1 |
| A4 Size | 0 | 1 |
| Legal Size | 1 | 0 |
| Cassette Absent | 0 | 0 |

As shown in Table 1, the two detection switches SW1 and SW2 permit precise detection of the paper size and the presence/absence of the paper feed cassette 18. When either of the detection switches SW1 and SW2 is in the "1" state, the paper feed cassette 18 is recognized as mounted in the paper feed portion 5. Thus, in this embodiment, with the two detection switches SW1 and SW2, it is possible to recognize five different states.

This embodiment deals with a case where three different paper sizes, namely letter size, A4 size, and legal size, are recognized. However, any other paper sizes than these may be targeted according to the use, the type of the image forming apparatus, and other factors. It is also possible to recognize more than three different sizes. In that case, by providing N detection switches, it is possible to structure a paper feed cassette that permits the recognition of at least [(N+1)+2] different states including the presence/absence of the paper feed cassette itself. Needless to say, the paper feed cassette provided with a size detection function according to the present invention applies not only to a particular type of image forming apparatus as shown in FIG. 1 but also, as necessary, to an image forming apparatus of any other type.

What is claimed is:

1. A paper feed cassette provided with a size detection function for use in an image forming apparatus, the paper feed cassette having a rear end restricting plate for restricting a position of a rear end of paper, the paper feed cassette being removably mounted in a paper feed portion provided inside a main body of the image forming apparatus, the paper feed cassette comprising:

a plurality of detection targets arranged along a paper feed direction on a bottom of a paper stage formed integrally with the rear end restricting plate;

a plurality of detection switches, arranged along the paper feed direction in the paper feed portion inside the main body of the image forming apparatus, for detecting positions of the detection targets; and a discriminator for recognizing paper size and the presence or absence of the paper feed cassette by receiving detection signals from the detection switches, wherein the paper feed cassette is so structured as to permit, assuming that there are provided N detection switches, recognition of at least (N+1) different paper sizes and of the presence/absence of the paper feed cassette.

2. A paper feed cassette provided with a size detection function as claimed in claim 1, wherein there are provided two detection switches and four detection targets, and the discriminator permits recognition of three different paper sizes and of the presence or absence of the paper feed cassette.

3. A paper feed cassette provided with a size detection function as claimed in claim 1, wherein the detection targets are ribs formed on the bottom of the paper stage so as to protrude downward.

4. A paper feed cassette provided with a size detection function as claimed in claim 1, wherein the detection targets are so formed that tips thereof face, through an elongate hole formed in a bottom plate of a cassette casing of the paper feed cassette, a bottom plate of the paper feed portion of the image forming apparatus.

* * * * *